United States Patent [19]

Larsson et al.

[11] 4,241,534

[45] Dec. 30, 1980

[54] TOY VEHICLE WITH SPRING DRIVE MECHANISM

[75] Inventors: Ake L. Larsson, Palos Verdes Estates; Gunther E. Gronwold, Manhattan Beach; Derek A. Corris, Venice, all of Calif.

[73] Assignee: Mattel, Inc., Hawthorne, Calif.

[21] Appl. No.: 12,085

[22] Filed: Feb. 14, 1979

[51] Int. Cl.[3] ..... A63H 29/20; F03G 1/10

[52] U.S. Cl. ..... 46/206; 185/39; 185/DIG. 1; 192/48.92

[58] Field of Search ..... 46/206; 185/39, DIG. 1; 192/46, 48.92; 64/29

[56] References Cited

U.S. PATENT DOCUMENTS

| | | | |
|---|---|---|---|
| 717,791 | 1/1903 | Adams | 192/46 |
| 1,203,438 | 10/1916 | Webster | 46/206 |
| 1,619,943 | 3/1927 | Lehwess | 58/83 R |
| 1,720,289 | 7/1929 | Odom | 185/43 |
| 1,962,056 | 6/1934 | Colomb | 58/83 R |
| 2,182,529 | 12/1939 | Wyrick | 185/39 |
| 2,617,248 | 11/1952 | Brown | 58/83 R |
| 2,637,987 | 5/1953 | Hill et al. | 64/29 |
| 2,741,873 | 4/1956 | Erickson | 46/206 |
| 3,798,831 | 3/1974 | Higashi | 46/206 |
| 3,812,933 | 5/1974 | Darda | 46/206 |
| 3,981,098 | 12/1976 | Darda | 46/206 |
| 4,053,029 | 10/1977 | Darda | 185/39 |
| 4,077,156 | 3/1978 | Asano | 46/206 |

FOREIGN PATENT DOCUMENTS

| | | | |
|---|---|---|---|
| 2166888 | 7/1976 | Fed. Rep. of Germany | 185/39 |
| 599429 | 1/1926 | France | 192/48.0 |
| 635944 | 4/1950 | United Kingdom | 46/206 |
| 277466 | 10/1970 | U.S.S.R. | 192/46 |

*Primary Examiner*—David L. Lacey
*Attorney, Agent, or Firm*—John G. Mesaros; Max E. Shirk; Ronald M. Goldman

[57] ABSTRACT

A toy vehicle having a spring drive mechanism coupled through first and second unidirectional slip clutch members to the drive wheels thereof, the slip clutches including gear members for winding the spring through a first gear ratio while pushing the vehicle in the reverse direction on a surface, and for propelling the vehicle through a second gear ratio upon release of the vehicle, each of the actions utilizing only one of the slip clutch members.

11 Claims, 5 Drawing Figures

TOY VEHICLE WITH SPRING DRIVE MECHANISM

BACKGROUND OF THE INVENTION

The background of the invention will be discussed in two parts:

1. Field of the Invention

This invention relates to toy vehicles having spring drive mechanisms, and more particularly to a spring drive mechanism which is would by urging the vehicle on a surface in a reverse direction.

2. Description of the Prior Art

Spring driven toy vehicles have taken many forms with the conventional configuration generally including a key for winding the spring and a lever coupled to the vehicle for releasing the energy stored in the spring for propelling the vehicle over a surface. Due to the utilization of the key member, often times full enjoyment of the vehicle was not had by the child due to loss of the key used for winding the spring motor, and the relative difficulty in finding a replacement.

More recent toy vehicles utilizing spring motors have been developed utilizing complex mechanisms for enabling the spring motors to be wound by manually moving the vehicle in the reverse direction. One such device is shown in U.S. Pat. No. 2,182,529 entitled "Mechanical Motor Drive" issued to Clayton E. Wyrick on Dec. 5, 1939. In this device, release of the vehicle after a predetermined movement thereof in the reverse direction enables the vehicle to move forward under power of the spring motor, with the transmission parts being so constructed to permit free coasting at the termination or rundown of the energy output of the spring. Furthermore, in this particular toy, the parts are so constructed and arranged for winding the motor faster in the reverse direction than it unwinds when the vehicle is traveling in the forward direction. For this purpose, a shifting frame member within the chassis is employed as part of the transmission mechanism.

Another such toy vehicle is shown and described in U.S. Pat. No. 3,981,098 entitled "Toy Vehicle with Component for Storing Energy in Response to Motion in Opposite Direction" issued to Helmut Darda on Sept. 21, 1976. In the toy vehicle of this patent, certain "one way devices" are utilized with an elaborate gearing structure, the vehicle according to the invention being illustrated in several different embodiments. The parent application of this patent issued into U.S. Pat. No. 3,812,933 on May 28, 1974.

Another spring drive mechanism is shown and described in U.S. Pat. No. 4,053,029 issued to Darda on Oct. 11, 1977 entitled "Spring Drive Mechanism, particularly for Mobile Toys."

Another such toy vehicle is shown in U.S. Pat. No. 4,077,156 entitled "Toy Vehicle with Energy Storing Mechanism" issued Mar. 7, 1978 to Kiyoji Asano, the vehicle including a gearing mechanism activated by rotation of the axle in one direction to store energy in the spring with the release of the axle thereafter releasing the stored energy for propelling the vehicle. The gearing mechanism includes a ratchet mechanism.

It is an object of the present invention to provide a new and improved toy vehicle with a spring drive mechanism.

It is another object of the present invention to provide a new and improved spring powered toy vehicle drive mechanism which is compact and uncomplicated.

SUMMARY OF THE INVENTION

The foregoing and other objects of the invention are accomplished by providing a toy vehicle having a chassis having at least one drive wheel rotatably mounted thereon, the drive wheel having a gear member affixed for concurrent rotation therewith. The chassis is provided with a recess for receiving a spring coupled to the shaft of a drive gear member having a second gear member mounted for rotation about the same axis. Adjacent faces of the gar members are configured for providing a first slip clutch for providing concurrent rotation of the two gears in only one direction. Third and fourth gear members are mounted for rotation about a second parallel axis or shaft with the facing surfaces of the third and fourth gear members being configured for providing a second slip clutch mechanism which is unidirectional for coupling the third and fourth gear members together for rotation in only one direction, this direction being opposite to that of the other two gear members. Each of the third and fourth gear members is in meshing engagement with one of the drive gear and intermediate gear members. One of the third and fourth gear members is operatively connected to the member mounted for concurrent rotation with the drive wheel. The gear diameters are so selected to provide first and second gear ratios for winding and unwinding the power spring respectively. The slip clutch of each gear pair is provided by a first gear surface having a recess formed therein with the periphery of the recess being contoured to provide a plurality of symetrically arranged generally identical irregular surfaces with each surface having two contiguous portions, one of which is gradually contoured with the other portion being abruptly contoured. The facing surface of the second gear of the gear pair is provided with a disc shaped portion having a thickness approximating that of the depth of the recess for rotation therein, the disc shaped portion having a transversely extending slot for receiving a pin slidable therein, the pin having a length slightly less than the shortest distance between opposing side walls of the recess. During relative rotation between the two parts, the pin "floats" from side to side in a first direction, and in a second direction of rotation, the pin engages the edge of the abruptly contoured portion for driving the gear pair concurrently.

The spring member and recess are coactingly configured for preventing overwinding of the spring.

Other objects, features and advantages of the invention will become apparent from a reading of the specification when taken in conjunction with the drawings in which like reference numerals refer to like elements in the several views.

DESCRIPTION OF THE PREFERRED EMBODIMENT

In prior art toy vehicles utilizing keyless spring drive mechanisms wherein the spring is wound by pushing the vehicle in reverse (and in some instances while applying downward pressure to the vehicle) with the energy so stored in the spring propelling the vehicle forward upon release of the vehicle, the mechanisms generally have required an inordinately large number of parts and elaborate mechanisms for accomplishing this. Generally speaking, with a larger number of parts, the cost of assembly and parts is generally higher with reliability being generally lower. As will hereinafter be described, the drive mechanism of the instant invention essentially utilizes two gear pairs with each gear pair mounted for rotation about the same axis with adjacent faces of each gear pair being configured for providing concurrent rotation of each gear of the gear pair in only one direction of rotation. With adjacent gears of the gear pairs in meshing engagement, a first gear ratio is effected for winding the spring with a second gear ratio effected for driving the vehicle. In addition to the spring, the total number of components required for the mechanism according to the invention includes the two gear pairs with a slip clutch pin for each of the gear pairs and appropriate gearing for interconnecting one of the gears of one of the gear pairs to the drive wheel, this gearing in the embodiment illustrated being a crown gear operating in conjunction with a pinion gear.

Figure 1:
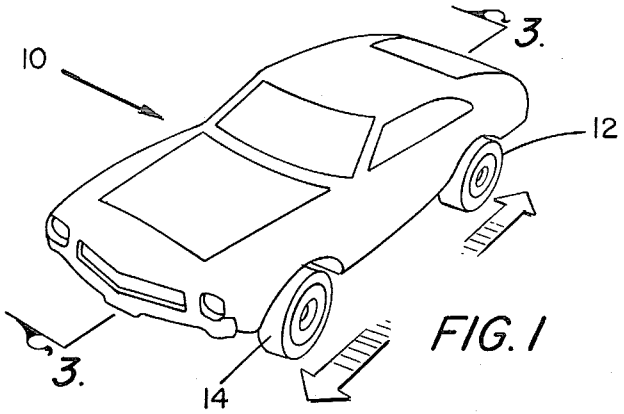
FIG. 1 is a perspective view of a vehicle utilizing the spring drive mechanism according to the invention.

Referring now to the drawings and particularly to FIG. 1 there is shown a toy vehicle generally designated 10 having at least one rear or drive wheel 12 and front wheels 14 (only one of each being shown) for rollingly engaging a surface. The toy vehicle is in the form of an automobile and with the wheels 12 and 14 engaging a surface and manually pushed rearwardly in the direction of the arrow adjacent the rear or drive wheel 12, a spring motor therein has energy stored in the spring with release of the vehicle 10 propelling it in the direction of the arrow adjacent the front wheel 14, that is, in the forward direction.

Figure 2:
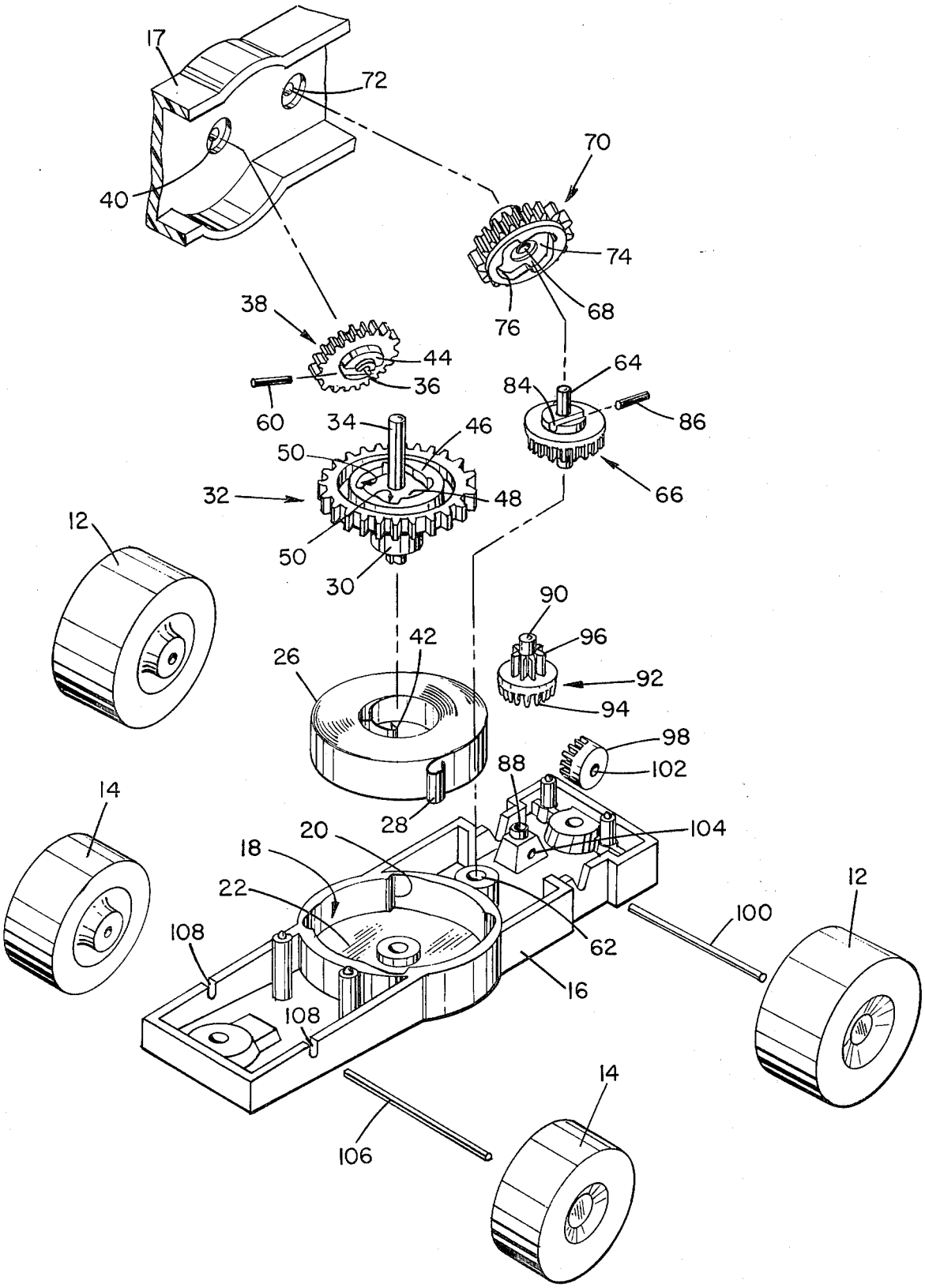
FIG. 2 is an exploded perspective view of the spring drive mechanism utilized in the toy vehicle of FIG. 1.

In FIG. 2, the main driving components of the vehicle are illustrated, these components being contained within a two part housing formed from a chassis 16 and an upper housing or cover member 17 for retaining the component parts therebetween. The lower chassis 16 is generally rectangular in configuration with upwardly extending sidewalls about the periphery thereof with a centrally disposed cavity or recess 18 formed therein, the recess 18 having a generally circular plan view with a plurality of equiangularly displaced detents 20 formed in the sidewall thereof. Centrally disposed within the bottom 22 of the recess 18 is a bearing aperture 24. A coil spring member 26 is configured for mating engagement within the recess 18, the coil spring 26 being generally circular in plan view and having an outside diameter in the unwound condition generally equal to the inside diameter of the recess 18 with the outer periphery of coil spring 26 normally engaging the sidewall of the recess 18. The coil spring 26 has the outer end 28 thereof bent rearwardly and configured for engaging one of the detents 20 to provide a normal engagement therewith during winding of the coil spring 26 until the coil spring 26 approaches a fully wound condition, at which point, the outer diameter thereof decreases slightly thereby providing a limited slip when the end 28 disengages from the engaged detent 20 due to the overwinding force with the end 28 then slipping into the next adjacent detent 20 in the direction of winding of the coil spring 26. This mating configuration of coil spring 26 within the recess 18 provides a slipping of the coil spring 26 within the recess 18 to prevent overwinding, with the attendant engagement and disengagement of the end 28 with the detents 20 providing an audible sound to the operator thereby signalling the overwinding of the spring motor mechanism.

With the coil spring 26 within the recess 18, the diameter of the inner opening of the coil spring 26 is sufficient for passage therethrough of a spring receiving hub portion 30 of a drive gear member generally designated 32 which is provided with a centrally disposed axle portion 34, the lower end of which is received within the bearing aperture 24 and the upper end thereof being of a length sufficient for passage through a centrally disposed aperture 36 of an intermediate gear member generally designated 38 with the upper end of axle portion 34 being rotatably received within an aperture 40 formed in the undersurface of the upper cover member 18. The gear members 32 and 38 form a first gear pair rotating about a common axis defined by the axle portion 34 of the drive gear member 32. The inner end 42 of coil spring 26 is secured to the hub portion 30 for winding the coil spring 26 in response to rotation of drive gear member 32 as will hereinafter be described.

Figure 4:
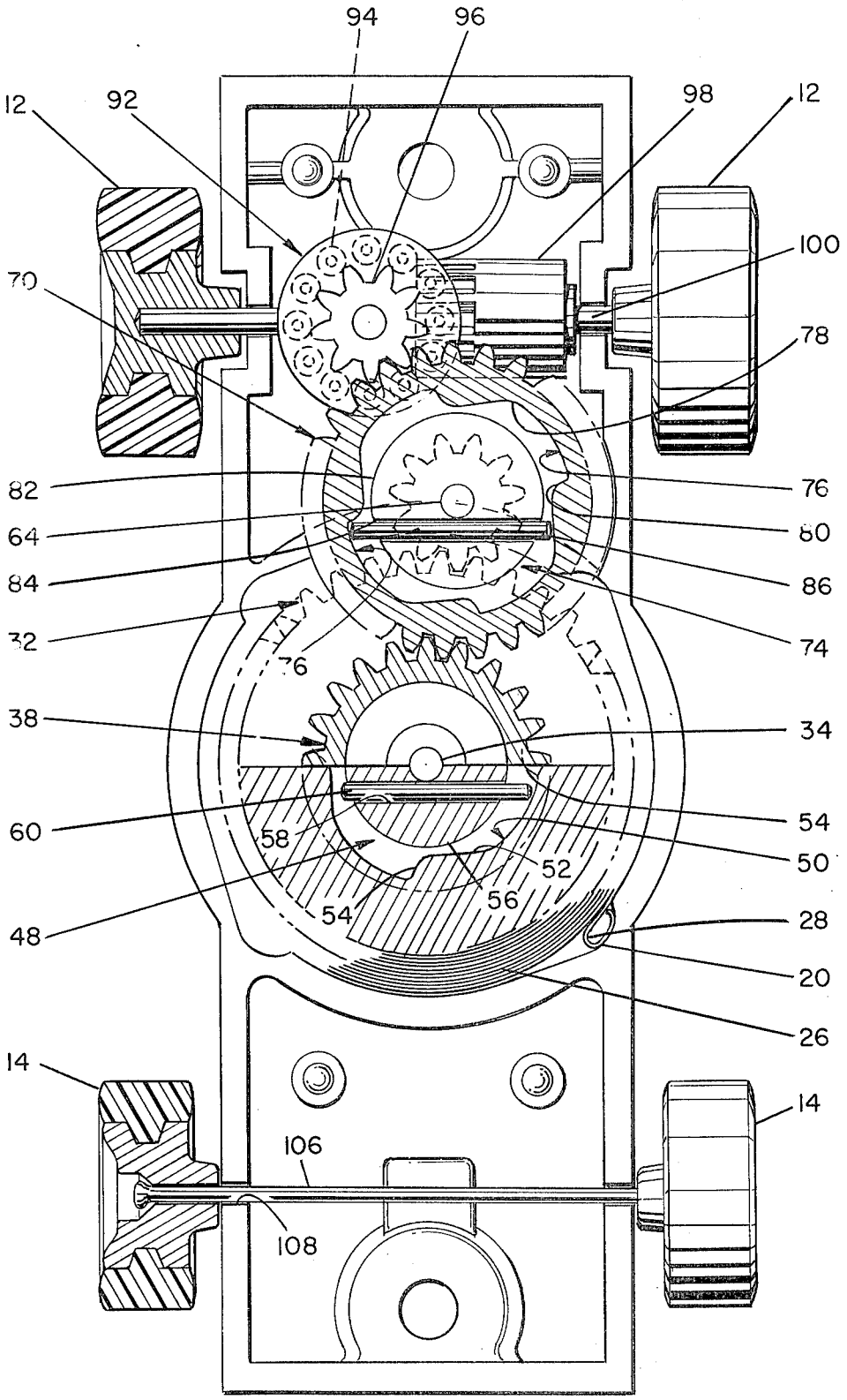
FIG. 4 is a cross sectional view of the spring drive mechanism of FIG. 3 as viewed generally along broken line 4—4 thereof.

Referring also to FIG. 4, with the aperture 36 of intermediate gear member 38 rotatably positioned about the axle portion 34, the facing surfaces 44 and 46 of gear members 38 and 32 respectively are suitably configured for providing a slip clutch means for providing concurrent rotation of the two gear members in only one direction with slippage therebetween during rotation in an opposite direction. The surface 46 of drive gear member 32 is provided with a recessed portion 48 which is generally circular in plan view with the sidewall thereof configured for providing two pairs of diametrically opposed generally identical irregularly configured detents or pocket portions generally designated 50, each of the pocket portions 50 having a first gradually sloping surface 52 leading into the pocket with an abruptly terminating edge portion 54 defining the other end of the pocket portion 50. The surfaces 52 and 54 are contiguous and continuous and, as illustrated in FIG. 4, adjacent pocket portions 50, in the clockwise direction, each commence with a gradually sloping surface 52 to an abruptly terminating edge portion 54. The surface 44 of intermediate gear member 38 is contoured to provide a disc portion 56 having a thickness approximating that of the depth of the recess for rotation therein and a diameter slightly less than the shortest diametrical measurement within recess 48. The disc portion 56 is provided with a transversely extending slot 58 for receiving a movable pin member 60 having a length greater than the length of the slot 58 but less than the least distance between two points on the sidewalls of the recess 48 in alignment with either end of pin 60, this coaction providing a unidirectional clutch means which enables the two gears of the gear pair to rotate concurrently in a first relative direction of rotation, and to rotate independently of each other in an opposite direction of rotation. As illustrated in FIG. 4 if the drive gear member 32 is rotated in a clockwise direction relative to intermediate gear member 38, an abruptly terminating edge portion 54 of a pocket portion 50 next adjacent an end of the pin member 60 will engage the end of pin member 60, thereby driving intermediate gear member 38 likewise in a clockwise direction. Conversely, if the relative direction of rotation is in the opposite direction with the drive gear member 32 rotating counterclockwise relative to intermediate gear member 38 the end of pin 60 will follow the smoothly contoured or gradually sloping surface 52 of the pocket portion 50 simply sliding back and forth within slot 58 during this rotation to thereby provide a slip clutch between the two gears of the gear pair.

Referring again to FIGS. 2 and 4, the chassis 16 is provided with a second bearing aperture 62 rearwardly of the recess 18 for receiving therein the lower portion of shaft 64 of a third gear member 66, the shaft portion 64 thereof having a length sufficient for passage through an aperture 68 of a fourth gear member 70 with the upper end of shaft portion 64 rotatably engaging a bearing aperture 72 formed within the undersurface of cover member 18. The third and fourth gear member 66 and 70 form a second gear pair mounted for rotation about a second axis defined by shaft portion 64, the second axis being parallel to the first axis defined by axle portion 34 of the drive gear member 32. In the assembled condition, the gear teeth of the third gear member 66 are in meshing engagement with the gear teeth of the drive gear member 32 while the gear teeth of the fourth gear member 70 are in meshing engagement with the gear teeth of the intermediate gear member 38.

The second gear pair is likewise provided with a unidirectional clutch means generally identically configured to the first clutch means of the first gear pair. The facing surfaces of the second gear pair are configured to provide a recess 74 formed in the undersurface of the fourth gear member 70 with two pairs of pocket portions 76 formed in the sidewall of recess 74 with each pocket portion 76 having a gradually sloping surface 78 with a contiguous continuous abruptly terminating edge portion 80. The lower gear that is the third gear member 66 has the upper surface thereof configured with a disc portion 82 and a transversely extending slot 84 offset from the axis or shaft portion 64 thereof, with the slot 84 receiving therein a slidable or movable pin member 86. The dimensioning and spacing of the component parts are generally identical or proportional to the like parts of the first unidirectional slip clutch means. As illustrated in FIG. 2, the second clutch means is in generally inverted relation relative to the first clutch means for providing unidirectional coupling in a direction of rotation opposite to the unidirectional coupling direction of rotation afforded by the first clutch means. By reference specifically to FIG. 4, it can be seen that the disposition of the pocket portions 76 relative to the pocket portions 50 is in mirror image relation in plan view.

Positioned rearwardly of the bearing aperture 62 within the lower chassis 16 is another bearing aperture 88 configured for rotatably receiving therein the lower portion of the axle or shaft 90 of a crown gear member generally designated 92, the crown gear member 92 having a plurality of downwardly extending crown teeth 94 and an upwardly disposed pinion portion 96 for meshingly engaging the gear teeth of the fourth gear member 70. The driving connection to the rear wheels 12 is accomplished through a pinion gear member 98 integral with or affixed to at least one of the drive wheels 12. In the embodiment illustrated, at least one of the drive wheels 12 is press fit onto an axle 100 which frictionally receives the pinion gear member 98 by insertion through an aperture 102 thereof, the axle 100 then being rotatably received within an axle bearing 104 formed in a block member integral within the interior of chassis 16, the other wheel 12 being either press fit onto the axle 100 or rotatable relative thereto. In the assembled position, the teeth of the pinion gear member 98 engage the crown teeth 94 of the crown gear member 92. The front wheels 14 are retained in any suitable fashion on the front end of chassis 16. For example, the front wheels 14 may be press fit onto an axle 106 which is retained within slot portions 108 formed in the sidewalls of chassis 16 adjacent the front end thereof with the upper cover member 17 being configured for retaining the axle 106 therein.

Figure 5:
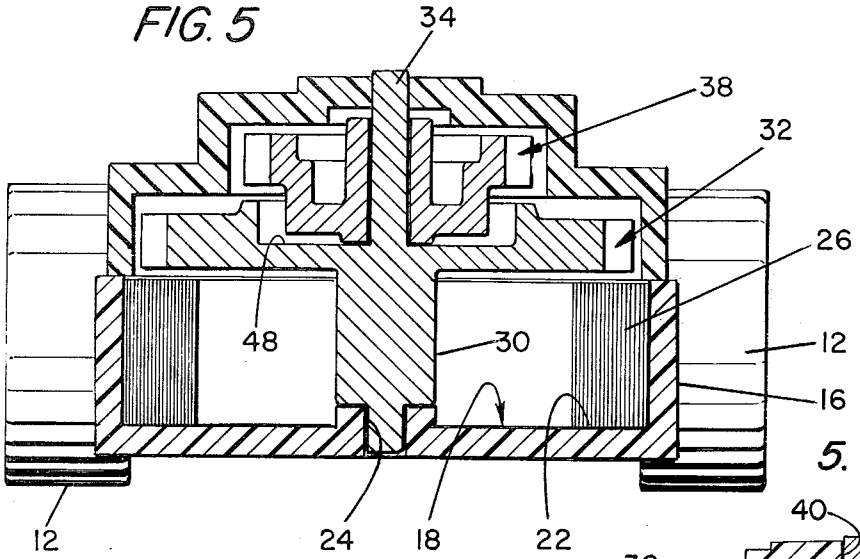
FIG. 5 is a cross sectional view of one gear pair used in the spring drive mechanism of FIG. 3 as viewed generally along line 5—5 thereof.
Figure 3:
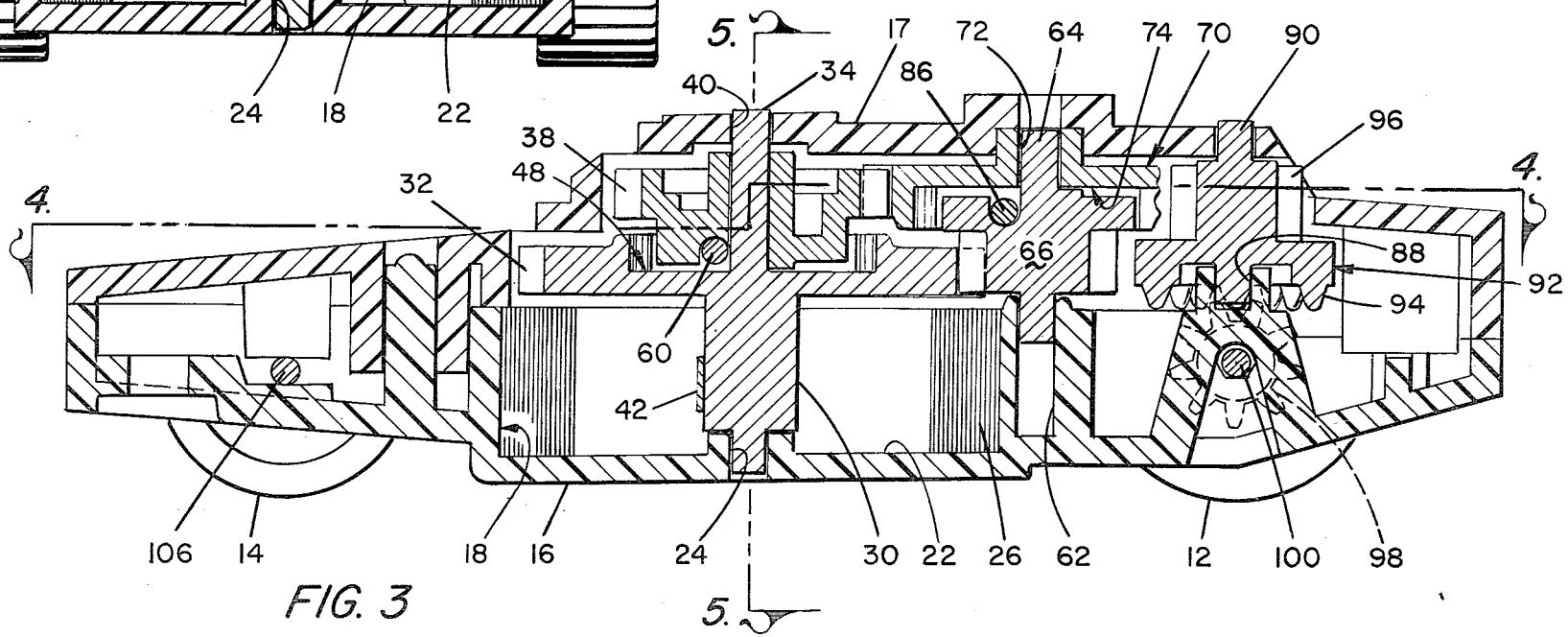
FIG. 3 is a cross sectional view of the spring drive mechanism as viewed generally along line 3—3 of the toy vehicle of FIG. 1 with the body thereof removed.

The operation of the spring drive mechanism according to the invention will now be discussed with reference to FIGS. 3–5 inclusive. The component parts are illustrated in assembled relation in side cross section in FIG. 3 between chassis 16 and cover member 17 and essentially include the first gear pair consisting of drive gear member 32 and intermediate gear member 38 rotating about a first axis defined by shaft 34 with the second gear pair rotating about a parallel axis defined by shaft portions 64, the second gear pair including gear members 66 and 70. The fifth and sixth gears including crown gear member 92 and pinion gear member 98 effectively provide a 90° translation of motion for driving the rear drive wheel 12. As can be seen, the axes of rotations of the first gear pair, the second gear pair and the crown gear member 92 are generally parallel to each other, and in the embodiment illustrated in vertical relation to the surface upon which the vehicle 10 will ride.

The description of operation will proceed with reference to the "wind up" direction, that is with the vehicle 10 moved rearwardly over a surface engaged by the drive wheel 12, and the running or "unwinding" condition, that is with the vehicle 10 propelled in the forward direction under force of the spring motor. By reference specifically to FIGS. 3 and 4 as the vehicle 10 is pushed over the surface rearwardly, the drive wheel 12 and consequently the pinion gear member 98 coupled for rotation therewith rotates in a clockwise direction thereby rotating the crown gear member 92 in a counterclockwise direction. With the pinion gear portion 96 of crown gear member 92 in meshing engagement with the fourth gear member 70, the fourth gear member 70 will be rotated in a clockwise direction which thereupon, with the engagement of the teeth thereof in meshing relation with intermediate gear member 38, drives intermediate gear member 38 in a counterclockwise direction. With fourth gear member 70 rotating clockwise during the windup condition, the third gear member 66 is not locked for rotation therewith due to the orientation and alignment of the relative surfaces of each pocket portion 76 with the pin member 86 sliding relative to opposite surfaces contacting the ends thereof.

On the other hand, with the intermediate gear member 38 rotating during the windup condition in a counterclockwise direction, an edge of the pin 60 will engage an abruptly terminating edge portion 54 of the nearest pocket portion 50 to thereby drive the drive gear member 32 in the same direction, that is, in a counterclockwise direction which is the winding direction for storing energy in the coil spring 26. If the rearward movement of the vehicle 10 exceeds the distance required for full windup of the coil spring 26, due to the relaxing of the tension against the end 28 of the coil spring 26 in engagement with one of the detents 20, any attempt to overwind the vehicle 10 will result in the end 28 being released from within one of the detents 20 with resulting counterclockwise movement of the coil spring 26 within the recess 18 until the next detent 20 is engaged by the pin 28. This construction prevents overwinding of the coil spring 26 which is the source of stored energy for the spring motor mechanism. During this windup operation, due to the meshing engagement of the gear teeth of drive gear member 32 with the gear teeth of third gear member 66, the third gear member 66 will be rotating at a speed determined by the gear ratio between the gear teeth with this rotation being independent of but relative to, the rotation of the fourth gear member 70 which is coupled into the windup gear transmission.

The transmission of power from the rear or drive wheel 12 to the coil spring 26 is effected through the pinion gear member 98, through the crown gear member 92, through the fourth gear member 70, and through the locked gear pair including intermediate gear 38 and drive gear member 32.

Once the spring motor is sufficiently wound and the vehicle 10 released, the power stored in the spring 26 is released with the transmission of power being effected from the drive gear member 32 through the locked second gear pair, that is third and fourth gear members 66 and 70, through the crown member 92, and thence to the pinion gear member 98 which drives the drive wheels 12 in a direction of rotation for propelling the vehicle forward. During this "unwinding" or driving condition, due to the unidirectional clutch mechanism of the second gear pair being inverted, or in mirror image relation, to the unidirectional clutch means of the first gear pair, the second gear pair is locked for concurrent rotation. With intermediate gear member 38 having the teeth thereof in meshing engagement with the gear teeth of the fourth gear member 70, intermediate gear member 38 will likewise rotate but at a different speed relative to the other half of its gear pair, that is, drive gear member 32.

At the end of the unwinding of the power or coil spring 26, the vehicle 10 will free-wheel for a distance thereafter due to the slip clutch arrangement. This is effected in the following manner. At the end of the unwinding, due to the coupling of the spring end 42 to the drive gear member 32, drive gear member 32 will be stationary, and with the meshing engagement between the gear teeth of drive gear member 32 and third gear member 66, the third gear member 66 will likewise be stationary. At this point, the forward motion of the vehicle will cause the fourth gear member 70 to be rotating in a clockwise direction with intermediate gear member 38 rotating in a counterclockwise direction. At this point with the lower gears stationary, the relative speed differential between the upper and lower gear members of each pair changes. Due to the configuration of the cammed surfaces of the pocket portions 76 and 50 of gear members 70 and 38 respectively, and the offset orientation of the clutch pins 86 and 60, respectively relative to the axis of rotation, the pins 86 and 60 will slide back and forth in the slots 84 and 58 respectively. With both "clutches" slipping at this point, the vehicle will free-wheel a distance determined by the momentum of the vehicle as well as the surface on which it is riding. This "slipping" effect of both clutches is due, in part, to each gear of the gear pairs having an odd number of teeth, coupled with the symmetrical arrangement of the pocket portions 50 and 76 of gear members 32 and 70 respectively. In the present embodiment gear member 32 has 37 teeth, gear member 38 has 21 teeth, gear member 70 has 27 teeth and gear member 66 is provided with 11 teeth, these gears providing a phase relation with the pocket configurations to enable both clutches to slip with the drive gear member 32 stationary.

The gear ratios of the various gear members are selected so that during the winding condition, that is, pushing the vehicle 10 in the reverse direction for winding the spring 26, the gear ratio is about 3:1 so that the spring 26 may be wound by a short rearward push. However, when the vehicle 10 is propelled in the forward direction, the gear ratio is 13:1 so that the energy stored in the coil spring 26 will drive the vehicle 10 a good distance. The gear ratios stated are illustrative and not intended to be limiting inasmuch as, obviously, the gear ratios can be altered by appropriate selection of the gears. However, consistent with the hereinabove described invention, the total number of components used for winding and propelling the vehicle are essentially two gear pairs with the mating faces of each gear pair configured for providing a limited slip clutch means in conjunction with the two pins thereof, a third pair of gears which essentially translate the motion of the horizontally rotating gear pairs to a direction 90° therefrom the driving the drive wheel 12, and a coil spring 26 for storing and releasing energy. This uncomplicated arrangement of very few parts is in vast contrast to the prior art devices. It is also to be understood, however, that while the motive parts have been illustrated as being arranged in a generally horizontal direction, the coil spring 26 along with the gear pairs may be mounted in a vertical direction while accomplishing the same result with few movable, highly reliable components.

While there has been shown and described a preferred embodiment it is to be understood that various other adaptations and modifications may be made within the spirit and scope of the invention.

What is claimed is:

1. In a toy vehicle, the combination comprising:

a chassis;

at least one drive wheel coupled for rotation relative to said chassis, said at least one drive wheel being configured for engaging a surface;

spring means within the chassis;

a first gear pair having first and second gear members mounted for rotation about a first axis, one of said first and second gear members being operatively coupled to said spring means for storing energy in said spring means when rotated in a first direction and for releasing energy from said spring means during rotation in a second direction;

a second gear pair having third and fourth gear members mounted for rotation about a second axis generally parallel to said first axis, said first and third gear members being in meshing relation, and said second and fourth gear members being in meshing relation;

coacting means integrally formed in adjacent surfaces of said first and second gear members for providing a first unidirectional clutch means for concurrent rotation between said first and second gear members only in a first direction;

coacting means integrally formed in adjacent surfaces of said third and fourth gear members for providing a second unidirectional clutch means for concurrent rotation between said third and fourth gear members only in a direction opposite to said first direction; and means interconnecting said at least one drive wheel with one of said third and fourth gear members, said third and fourth gear members being so dimensioned for providing a first gear ratio for driving said one of said first and second gear members in said first direction with said at least one drive wheel rollingly engaging a surface in the reverse direction of travel of said vehicle and for providing a second gear ratio for propelling said vehicle on a surface with said one of said first and second gear members rotating in said second direction under force of said spring means

2. The combination according to claim 1 wherein said coacting means for providing a first unidirectional clutch means includes a recess formed in the surface of one of said first and second gear members with the periphery of said recess contoured for providing a plurality of generally identical curved surfaces with each surface having a gradually contoured portion and an abruptly contoured portion, and the adjacent surface of the other of said first and second gear members has a part thereof extending within said recess with said part having a slot therein, and a pin member is slidably positioned within said slot, said pin member and the periphery of said recess being configured for enabling one end of said pin member to engage an abruptly contoured portion of one of said surfaces for driving said first and second gear members concurrently in a first direction of rotation and for enabling said pin member to generally slide over said gradually contoured portions upon rotation of one of said gear members in the opposite direction.

3. The combination according to claim 2 wherein said coacting means for providing said second unidirectional clutch means includes adjacent surfaces of said third and fourth gear members being configured generally identically to the adjacent surfaces of said first and second gear members but in inverted relation thereto.

4. The combination according to claim 3 wherein said interconnecting means includes other gear means.

5. The combination according to claim 4 wherein each of said recesses is configured with an even number of curved surfaces and each of said gear members of said first and second gear pairs is provided with an odd number of teeth for enabling both of said pin members to slide within its respective slot without engaging any portion of its respective recess for enabling said vehicle to continue rolling upon complete unwinding of said spring means and the stopping of rotation of the gear member operatively coupled to said spring means.

6. The combination according to claim 5 wherein each of said slots is offset relative to the axis of rotation of the respective gear member.

7. The combination according to claim 6 wherein said spring means includes a coil spring and said chassis is provided with a recess having a plurality of detents about the periphery thereof, the outer end of said coil spring being configured for frictionally fitting within one of said detents for enabling slippage of said free end to an adjacent detent upon excessive winding of said coil spring.

8. The combination according to claim 7 wherein said at least one drive wheel includes an axle secured for rotation therewith and said other gear means includes a pinion gear member coupled to said axle for rotation therewith.

9. The combination according to claim 8 wherein said vehicle is in the form of a toy automobile.

10. In a mechanism, the combination comprising:

a first gear member mounted for rotation about an axle;

a second gear member mounted for rotation about the same axle in proximity to said first member;

a first surface of said first member having a recess formed therein with the periphery thereof contoured for providing a plurality of generally identical curved surfaces with each surface having a gradually contoured portion and an abruptly contoured portion;

an adjacent surface of said second member having a part thereof extending within said recess, said part having a slot therein offset relative to the axis of rotation of said axle;

a pin member slidably positioned within said slot, said pin member and the periphery of said recess being configured for enabling one end of said pin member to engage said abruptly contoured portions of one of said surfaces for driving said first and second members concurrently in a first direction of rotation and for enabling said pin member to generally slide over said gradually contoured portions upon rotation of one of said members in the opposite direction whereby to provide a unidirectional clutch mechanism;

a second axle generally parallel to the first axle;

third and fourth gear members mounted for rotation about said second axle, said first and third gear members being in meshing relation, and said second and fourth gear members being in meshing relation, adjacent surfaces of said third and fourth gear members being generally identically configured to the adjacent surfaces of said first and second gear members but in inverted relation relative thereto for providing a second unidirectional clutch mechanism for concurrently driving said third and fourth gear members in a direction opposite to the direction of concurrent rotation of said first and second gear members;

a rotatable member; and means interconnecting said rotatable member to one of said third and fourth gear members, said first, second, third and fourth gear members being so dimensioned for providing a first gear ratio in one direction of rotation of said rotatable member and a second gear ratio in the opposite direction of rotation thereof.

11. The combination according to claim 10 wherein said mechanism further includes spring means operatively coupled to one of said first and second gear members for storing energy in said spring means during rotation in one direction and for releasing energy from said spring means during rotation in an opposite direction.

* * * * *